United States Patent [19]

Bako et al.

[11] 4,048,821

[45] Sept. 20, 1977

[54] COMBINATION PADLOCK

[75] Inventors: Lazlo Bako, Woodcliff Lake; Rudolf Wingert, High Crest Lake, both of N.J.

[73] Assignee: Presto Lock Company, Division of Walter Kidde & Company, Inc., Elmwood Park, N.J.

[21] Appl. No.: 653,722

[22] Filed: Jan. 30, 1976

[51] Int. Cl.[2] ..... E05B 37/06

[52] U.S. Cl. ..... 70/25; 70/314; 70/316

[58] Field of Search ..... 70/24, 25, 26, 312, 70/314, 315, 316, 317, 318, DIG. 44

[56] References Cited

U.S. PATENT DOCUMENTS

| | | | |
|---|---|---|---|
| 940,763 | 11/1909 | Whalen | 70/318 X |
| 1,964,936 | 7/1934 | Denerich | 70/25 |
| 2,114,073 | 4/1938 | Denerich | 70/25 |
| 2,163,852 | 6/1939 | Pond | 70/25 X |
| 2,183,168 | 12/1939 | Pond | 70/25 |
| 2,183,792 | 12/1939 | Eden | 70/25 |
| 3,720,082 | 3/1973 | Feinberg | 70/25 |
| 3,766,758 | 10/1973 | Heine | 70/25 |

*Primary Examiner*—Robert L. Wolfe
*Attorney, Agent, or Firm*—Shapiro and Shapiro

[57] ABSTRACT

A combination padlock has a plurality of permutation tumblers mounted on a member shiftable in a cavity in the body of the lock to effect a change in combination. Limit means cooperate with the tumblers for preventing the member from being shifted except when the tumblers are set in the correct combination. The member can be shifted in response to movement of the shackle of the padlock, but only when the lock is open. The bolt of the padlock and the shackle are designed to permit the tumblers to be scrambled when the lock is open, thus concealing the correct combination from unauthorized persons, and preventing the combination from being changed while the lock is open.

18 Claims, 12 Drawing Figures

COMBINATION PADLOCK

The invention relates to a combination padlock having permutation tumblers (i.e., tumblers that permit the combination of the lock to be changed), and is more particularly directed to a combination padlock whose combination can be changed only while the lock is open (i.e., the shackle is released and pulled outwardly), such padlock being termed a padlock of the type described.

BACKGROUND OF THE INVENTION

A padlock of the type described is shown in U.S. Pat. No. 3,766,758, issued Oct. 23, 1973, the disclosure of which is hereby incorporated by reference. In this padlock, release of the dials from the sleeves, which make up the tumblers, in order to permit relative rotation therebetween and a change in the combination, is brought about by displacing a shaft on which the tumblers are mounted. Displacement of the shaft is effected by movement of the shackle after the lock has been opened. Specifically, after the correct or open combination has been dialed, the shackle can be pulled outwardly of the lock and rotated 180° about the axis of the long leg of the shackle from a first to a second angular position. Upon reinsertion into the lock body of the long leg in its second angular position, a cam on the internal end of the long leg will be positioned next to an end of the shaft carrying the tumblers. The shackle can then be rotated out of its second angular position causing the cam to engage the end of the shaft and displace it to release the dials from the sleeves. After a new combination has been selected, the shackle can be rotated back to its second angular position, retracted, and then rotated 180° back to its first angular position in preparation for reinsertion to the body. After reinsertion, the tumblers can be scrambled to retain the shackle in the body thereby locking the padlock.

The chief advantages of this arrangement are that the combination can be changed only after the lock is open, thus requiring a person desiring to change the combination to have knowledge of the open or correct combination; that the essential shackle is constructed to enable its use to change or set the combination; and that there is no visible or obtrusive means for changing the combination. There is the disadvantage, however, in that the combination cannot be scrambled when the lock is open. As a consequence, the correct combination is ascertainable by an unauthorized person when the lock is open; also, the combination can be reset surreptitiously by an unauthorized person whenever the lock is open.

It is therefore an object of the present invention to provide a new and improved combination padlock of the type described wherein the limitations outlined above are overcome.

SUMMARY OF THE INVENTION

The combination padlock of the invention has a plurality of permutation tumblers mounted in a cavity of the body of the lock, the tumblers being individually rotatable to a predetermined angular position at which the open or correct combination is set to allow the shackle of the lock to be pulled outwardly to open the lock. The tumblers are mounted on a member shiftable in the cavity to effect a change in the combination of the lock. The shackle has a long leg extending into the cavity and is rotatable on the body about the longitudinal axis of the leg, the leg being shiftable in the body along its axis between a retracted position defining the locked state of the padlock, and an extended position defining the unlocked state of the padlock, A bolt in the cavity is cooperable with the tumblers and the shackle for preventing the leg, when it is retracted in a first angular position, from being shifted to its extended position except when the tumblers are set to the correct combination. After the leg is shifted to its extended position, and the lock is open, the bolt and the shackle are designed to allow the combination to be scrambled, thus concealing the correct combination from an unauthorized person. While the lock is open, movement of the shackle, preferably by linear movement, in order to shift the member on which the tumblers are mounted, can be carried out only if the tumblers are set in the correct combination, thus preventing unauthorized setting of the combination while the lock is open.

BRIEF DESCRIPTION OF THE DRAWINGS

An embodiment of the invention is illustrated in the accompanying drawings, wherein:

FIG. 7-A is a view of the internal end of the long leg of the shackle showing another form of cam arrangement;

DESCRIPTION OF THE PREFERRED EMBODIMENT

Figure 2:
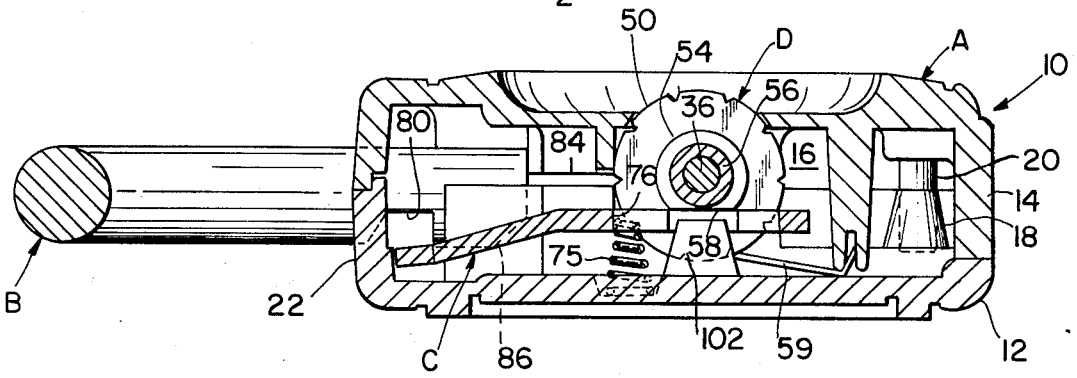
FIG. 2 is a cross-sectional view taken approximately along the line 2—2 of FIG. 1, but including the front half of the casing, this view showing the locking bolt in its inoperative position and the shackle released preparatory to withdrawing the same from the lock body.
Figure 3:
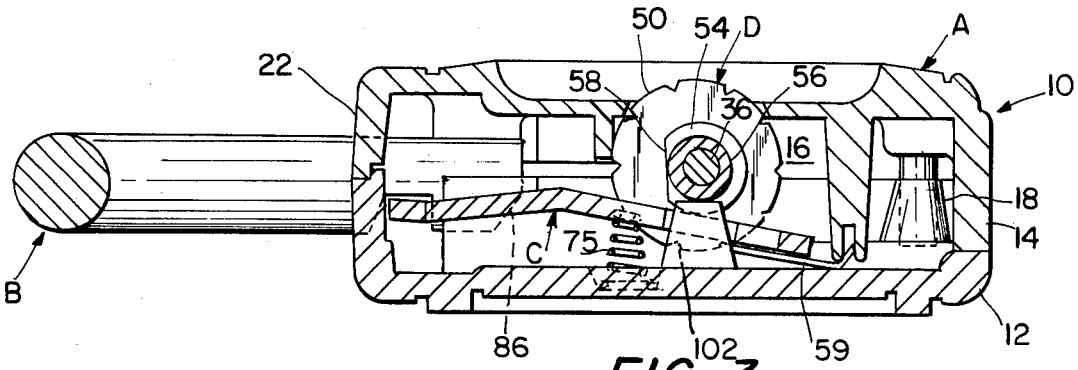
FIG. 3 is a cross-sectional view similar to FIG. 2, but showing the bolt in its operative position, restraining the shackle against withdrawal and showing the lock in its locked state.

Referring to the drawings, reference numeral 10 designates a combination padlock according to the present invention comprising body or housing A, shackle B, bolt C, and a plurality of permutation tumblers D. Body A is made up of a rear or female case 12 and a front or male case 14 fitted together as shown in FIGS. 2 and 3 to define a hollow cavity 16. The female case 12 has a plurality of upstanding receptacles 18 each having a central conical hole for receiving correspondingly positioned posts 20 on male case 14 after the various components of the lock have been assembled into the cases. Once posts 20 are pressed into the holes in receptacles 18, the cases are permanently connected together and cannot be separated without destroying the lock.

Figure 1:
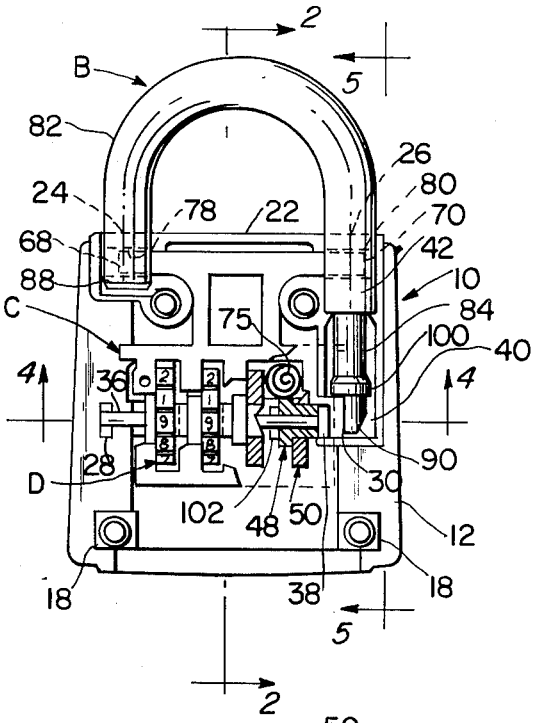
FIG. 1 is a plan view of a padlock according to the invention with the front half of the casing removed and portions of the padlock broken away to facilitate illustration of the construction of the lock.
Figure 4:
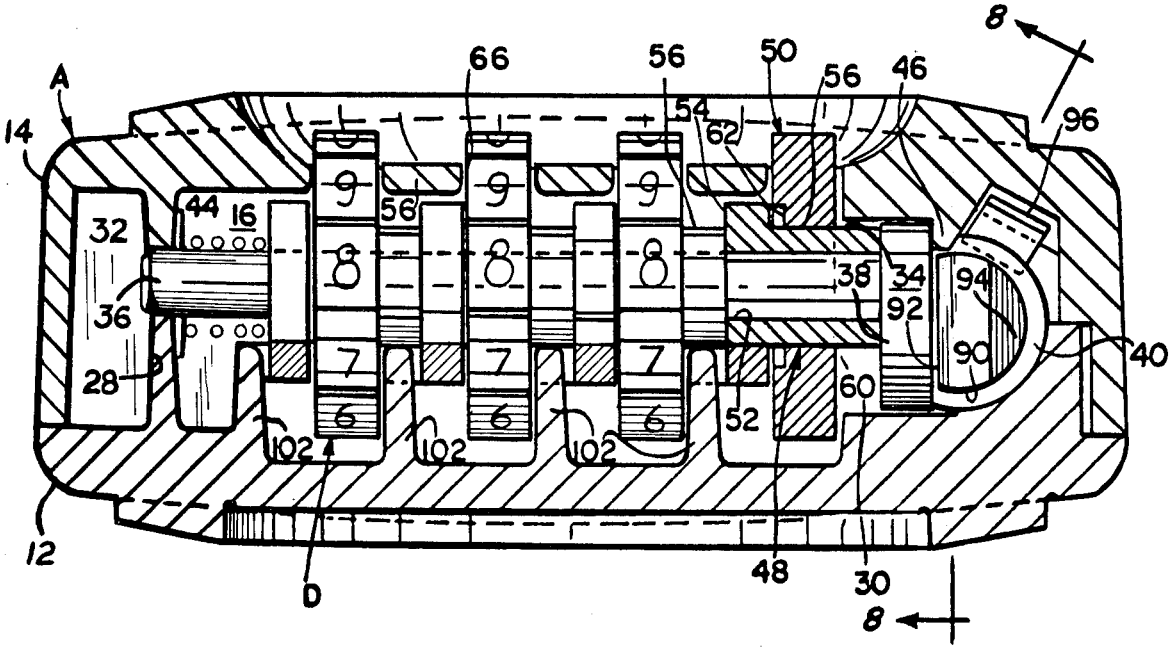
FIG. 4 is a view taken approximately along the line 4—4 of FIG. 1, showing the tumblers set in the open combination, this view including the top half of the casing.

Each case 12, 14 has a pair of matching half-circular apertures at the top end 22, so that upon assembly, a pair of shackle apertures 24 and 26 are formed in the top end of the body. Case 12 has a shaft supporting lug 28 centrally located adjacent one side of the case and in alignment with the head supporting depression 30 centrally located on the opposite side of the case as shown in FIGS. 1 and 4. A matching lug 32 and depression 34 are provided in case 14. The free ends of lugs 28 and 32 are provided with semi-circular notches for receiving the free end of shaft 36 which is restrained against rotation relative to the body by the engagement of enlarged head 38 with the narrow sides of depressions 30 and 34. Depressions 30 and 34 open into cavity 40 within which the long leg 42 of shackle B is received. As shown in FIG. 4, head 38 is urged into the cavity 40 by spring 44 interposed between lugs 28 and 32 at one end, and a tumbler D at the other end. Spring 44 resiliently urges head 38 into engagement with stop 46, thus limiting axial displacement of the shaft in one direction. The clearance afforded by depressions 30 and 34, however, permits the head 38 and the shaft 36 attached thereto, to move axially against the force of the spring 42.

Figure 10:
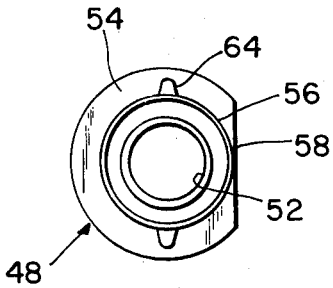
FIG. 10 is a plan view of a sleeve that forms one portion of a tumbler.
Figure 11:
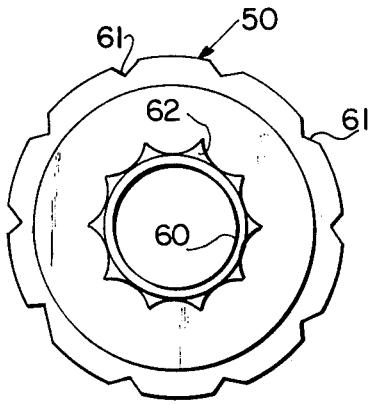
FIG. 11 is a plan view of a dial that forms the other portion of a tumbler.

The tumblers D are similar to the tumblers disclosed in U.S. Pat. No. 3,766,758, which disclosure is hereby incorporated by reference, and the following description is merely for completeness here. As shown in FIGS. 4, 10, and 11, each tumbler comprises a sleeve 48 and a dial 50. Sleeve 48 has a central bore 52 that receives shaft 36 enabling a plurality of sleeves to be passed over the free end of the shaft into end-to-end abutting relationship, the sleeves being rotatable on the shaft. Each sleeve has a flange 54 integral with a hub 56 of a diameter smaller than the diameter of flange 54. As shown in FIGS. 2, 3 and 10, flange 54 of each sleeve has a flat 58 whose distance from the center of the flange is substantially the same as the diameter of hub 56.

Each dial 50 is circular, and as shown in FIG. 4, bears numbered indicia on its periphery for identifying the angular position of the dial. A central bore 60 through a dial slidably receives hub 56 of a sleeve. A plurality of recesses 62 (FIG. 11) are provided in the axial face of the dial adjacent flange 54 and of the sleeve. Detents 64 (FIG. 10) on the face of flange 54 of a sleeve are selectively engagable with recesses 62 in the dial for the purpose of selecting the angular position of the dial relative to the sleeves when both rotate as a unit. As in the case of U..S. Pat. No. 3,766,758, the dials and sleeves are assembled end-to-end on shaft 36 as shown in FIG. 4, and the dials project through slots 66 in case 14 allowing the dials to be manually rotated, individually, to set the angular position of the flats 58. Detent spring 59, cantilevered between a post on the case 14, as shown in FIGS. 2 and 3, and the inner surface of case 12, resiliently seats in notches 61 in the periphery of each dial and resiliently holds the dial in the selected angular position. When the dial has rotated so that all of the flats are aligned as shown in FIG. 2, the lock is on the open or correct combination, allowing bolt C to move from its operative position (FIG. 3) to its inoperative position (FIG. 2) as described below.

Figure 9:
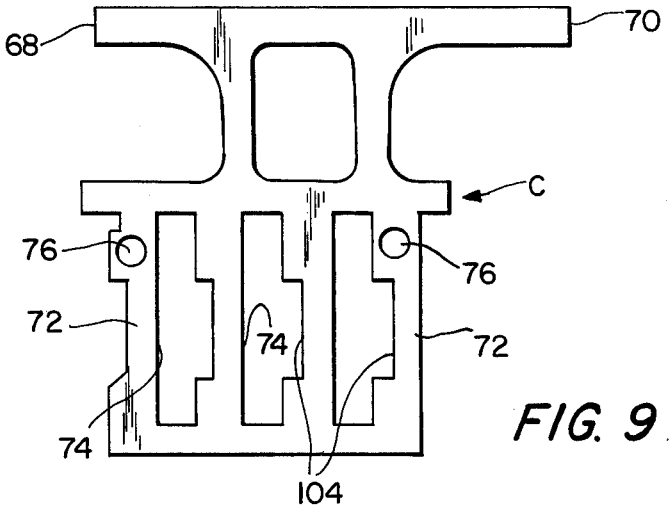
FIG. 9 is a plan view of the bolt.

As shown in FIGS. 2, 3 and 9, bolt C is a plate-like member with a pair of spaced-apart locking portions 68, 70 at one end, and a plurality of tumbler engaging portions 72 near the other end. Portions 72 are formed by longitudinal notches 74 that provide clearance for dials 50 allowing the bolt to be supported in cavity 16 by a pair of conical coil springs 75. The larger diameter end of each spring 75 fits into a matching depression in case 12, and the smaller diameter end of the spring fits into hole 76 in the bolt. Springs 75 urge portions 72 of the bolt into engagement with the periphery of flanges 54 on the tumblers.

When one or more of the flats 58 on the sleeves 48 of the tumblers is out of engagement with portions 72 of the bolt, the remaining sleeves hold the bolt in the position shown in FIG. 3, such position being termed the operative position of the bolt, because locking portions 68 and 70 are positioned in locking recesses 78 and 80 of the shackle B when the latter is retracted in the body, as shown in FIG. 1. When all of the tumblers are set to the correct combination, all of the flats 58 will engage portions 72 of the bolt C, and the springs 75 will cause the bolt to pivot from its position shown in FIG. 3 to its position shown in FIG. 2, wherein the locking portions 68 and 70 are withdrawn from recesses 78, 80 of the shackle. For this reason, the position of the bolt shown in FIG. 2 is termed the inoperative position of the bolt.

The springs 75 serve a dual function. One function is to provide a bias that urges the bolt into engagement with the tumblers, and to provide a force that pivots the bolt C from its inoperative position to its operative position when the combination is scrambled. The other function of the springs is to provide a fulcrum about which the bolt pivots. The resilient nature of the springs also enable the combination to be scrambled while the leg 42 is in its extended position since any engagement of portions 68 and 70 with the bolt as the tumblers are scrambled will displace the bolt against the springs.

As shown in FIG. 1, locking recess 78 of shackle B is located in the short leg 82 of the shackle, and locking recess 80 is located in the long leg 42 which extends through opening 26 in the body into the cavity 40 as described above. Confining walls in the cases 12, 14 between cavity 40 and top 22 of the body, form a bearing for long leg 42. When the bolt is in its inoperative position, the shackle can be displaced along the axis of leg 42 from a retracted position as shown in FIG. 1 (wherein the short leg 82 is received in hole 24, and recesses 78 and 80 are adapted to receive locking portions 68 and 70 of the bolt), to an extended position wherein the short leg 82 is withdrawn from hole 24. When this movement or translation of the shackle occurs, leg 42 may be said to be in a first angular position. Once the leg 42 moves to its extended position, the angular position of the leg can be changed by rotating the leg in the body A.

The inner end of leg 42, between locking recess 80 and the free end of the leg, is reduced in diameter as indicated by portion 84 in FIG. 1. This provides clearance for locking portion 70 of the bolt when the combination is scrambled after the lock is opened. Scrambling of the combination while the lock is opened, which is to say, when the leg 42 is retracted, pivots the bolt C from its inoperative position (FIG. 2) to its operative position (FIG. 3). Neither of the legs of the shackle interfere with movement of the bolt to its operative position because, as to leg 82, it is clear of the body or housing, and as to leg 42, portion 84 thereof is small enough in diameter to allow the desired pivotal movement of the bolt to take place. Thus, portion 84 enables this combination to be scrambled when the leg is extended.

Figure 5:
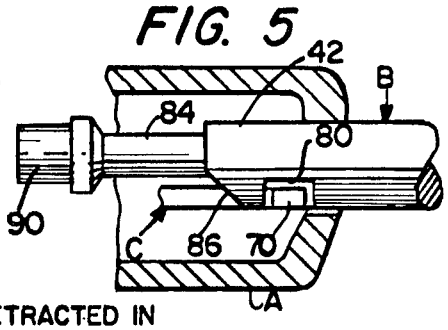
FIG. 5 is a cross-sectional view taken approximately along the line 5—5 of FIG. 1, this view including the top half of the casing.

After the lock has been opened, that is, after the shackle is extended and the tumblers are scrambled to conceal the correct combination, the bolt C will be in its operative position as described above. In order to enable the shackle to be returned to its retracted position, cam surface 86 on leg 42 (FIG. 5) and cam surface 88 on leg 82 (FIG. 1) are provided. Cam surface 86 is intermediate locking recess 80 and reduced portion 84, and is located on leg 42 in a region that faces locking portion 70 of the bolt when the shackle is in a position to be locked. Cam surface 88 on leg 82 is preferably formed as a conical taper on the free end of leg 82. The cam surfaces are in alignment for engagement with aligned bolt portions 68 and 70.

As the shackle is moved inwardly from its extended position toward its retracted position, cam surfaces 86 and 88 engage portions 68 and 70 respectively of the bolt, causing the latter to pivot from its operative to its inoperative position. In the operative position, the bolt will be pressed by springs 75 into engagement with the solid portion of the legs of the shackle, without interfering with movement of the shackle to its retracted position. When this position is reached, locking recesses 78 and 80 in the shackle are aligned with portions 68 and 70 of the bolt, and springs 75 cause such portions to snap into the locking recesses, thereby securing the shackle to the lock body. The padlock is now in its locked state.

Figure 6:
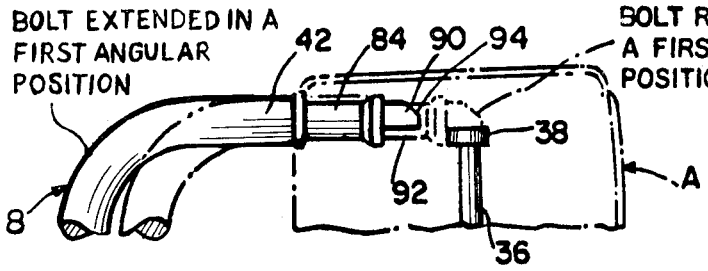
FIG. 6 is a partial schematic view showing the long leg of the shackle in its first angular position illustrating the movement of the shackle from its retracted to its extended position.
Figure 8:
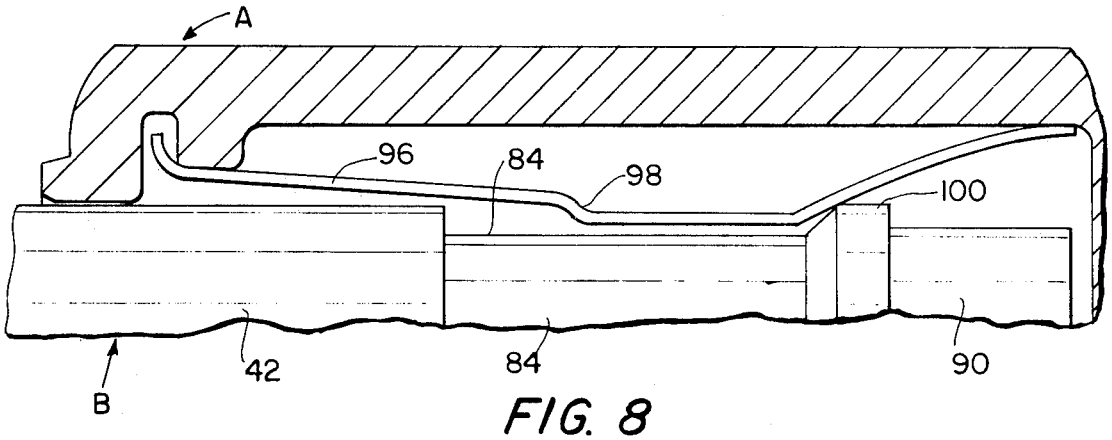
FIG. 8 is a sectional view taken along the lines 8—8 of FIG. 4.

In order to change the combination using the shackle as the operator, long leg 42 of the shackle is provided with eccentrically located cam member 90 as shown in FIGS. 1 and 6. Member 90 is located in cavity 40 adjacent to head 38 on shaft 36 when the shackle is in its retracted position, and has a relieved face 92 overlying head 38 as shown in FIG. 4, but clearing the head. In addition, member 90 has inclined surface 94 opposite face 92. The first step in changing the combination is to set the tumblers to the correct combination in order to allow springs 75 to release bolt C from the shackle which can then be moved from its retracted to its extended position as shown in FIG. 6. A spring 96 extends longitudinally into cavity 40 as shown in FIG. 4 and 8, and has a portion 98 that resiliently engages behind the hub 100 on leg 42 separating portion 84 from cam 90. Portion 98 cooperates with the hub 100 to releasably retain the shackle in its extended position while permitting the shackle to be rotated.

Figure 7A:
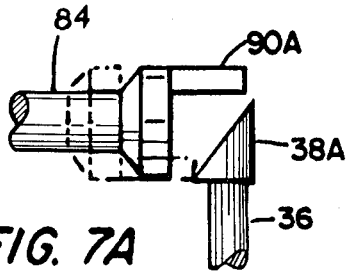
FIG. 7 is a partial schematic view showing the long leg of the shackle in its second angular position and movable from its extended to its retracted position.
Figure 7:
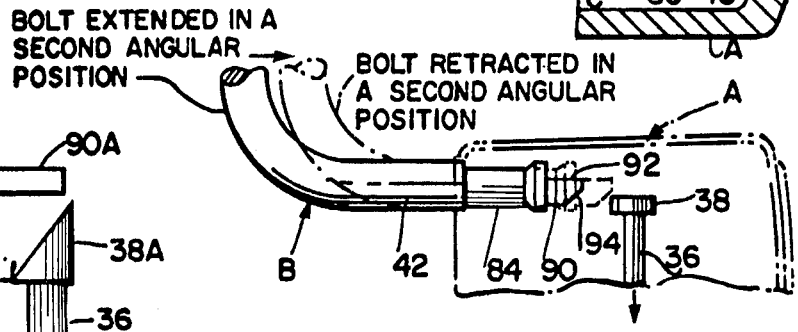

The shackle is rotated from its first angular position (i.e., the position in which the legs of the shackle are aligned with apertures 24 and 26 in the lock body), to a second angular position, preferably 180° from the first angular position. The second angular position of the shackle is shown in FIG. 7. In this position, the shackle will be releasably retained by spring 96 acting on hub 100, and member 90 will overlie head 38 because of the 180° rotation of leg 42 and the eccentric location of member 90 on the leg. Inward pressure on the shackle while the bolt is in its second angular position will move the leg 42 toward its retracted position. As this linear movement occurs, face 94 will engage head 38 and tend to axially displace shaft 36 against the action of spring 44. Cam 90 thus defines means provided by the shackle for shifting shaft 36. In order for axial displacement of the shaft to occur, the tumblers must be set to the open or correct combination, because only then are the flats 58 on sleeves 48 angularly located to clear ribs 102 associated with each sleeve, the ribs being formed integrally with case 12. As shown in FIG. 4, a rib 102 is located so as to lie beneath the end of the hub 56 of one sleeve and the flange 54 of an adjacent sleeve. The ribs extend into respective clearance notches 104 in the bolt on one side of each slot 74. The free end of each rib is no closer to the center line of shaft 36 than the distance of flat 58 is to the center line. As a consequence, only when the tumblers are set in the correct combination (i.e., when flats 58 are aligned with the free ends of rib 102) will shaft 36 carrying the sleeves be clear to move axially in response to the action of cam face 94 on head 38. In such case, the shackle B can be moved linearly to its retracted position. Thus, ribs 102 prevent shifting of shaft 36 except when the tumblers are set in the open combination.

Once the shackle 36 is linearly moved sufficiently to allow the sleeves to be disconnected from the dials, the latter will be freely rotatable on the hubs of the sleeves allowing the existing combination to be changed to a combination of one's own choice. Having selected a new combination, the shackle is linearly moved from its retracted to its extended position, allowing the shaft to return to its initial axial position and spring 44 to move the sleeves into a coupling connection to the dials. At this point, the lock is still open and the new combination has been set in the lock. The tumblers can now be scrambled to conceal such new combination, or the lock can be closed.

FIG. 7-A shows an alternative arrangement for using the linear movement of the shackle to create an axial displacement of the shaft carrying the tumblers. In this arrangement, portion 84 is provided with an eccentrically located member 90A instead of member 90, and shaft 36 is provided with a tapered head 38A. The solid lines of FIG. 7-A show the shackle retracted in its first angular position while the dotted lines show the shackle extended in its second angular position and about to be linearly moved inwardly, to allow member 90A to engage taper head 38A and axially displace shaft 36.

As a consequence of the above described construction, it is clear that the padlock of the invention is one in which the tumblers can be scrambled while the padlock is in its open state. This will permit the correct combination to be concealed from unauthorized persons. In addition, linear movement of the shackle is utilized to shift the member on which the tumblers are mounted in order to limit the axial force that can be applied to the member and thus prevent destruction of the limit means that cooperates with the tumblers and prevent shifting of the member except when the tumblers are set in the correct combination. By limiting the axial force an unauthorized person can exert on the member, it is not possible to force a combination change without knowledge of the correct combination.

It is believed that the advantages and improved results furnished by the combination padlock of the invention will be apparent from the foregoing description of several preferred embodiments of the invention. Various changes and modifications may be made without departing from the spirit and scope of the invention as sought to be defined in the following claims.

We claim:

1. A combination padlock comprising:

a. a body having an internal cavity;

b. a plurality of rotatable permutation tumblers;

c. a shiftable member in the cavity for changing the combination of the tumblers;

d. a shackle having a long leg extending into the cavity and rotatable on the body about the axis of the leg, the leg being shiftable in the body along its axis between retracted and extended position;

e. a bolt cooperable with the tumblers for preventing the leg, when it is retracted in a first angular position, from being shifted to its extended position except when the tumblers are set on open combination;

f. means enabling the combination to be scrambled when the leg is in its extended position;

g. means provided by the shackle for shifting the shiftable member; and h. means for preventing shifting of the shiftable member except when the tumblers are set in the open combination.

2. A combination padlock according to claim 1 wherein the means provided by the shackle is effective to shift the shiftable member only when the leg is in a second angular position and is shifted from its extended to its retracted position.

3. A combination padlock according to claim 2 wherein the second angular position is 180° from the first angular position.

4. A combination padlock according to claim 2 wherein the shiftable member includes a shaft mounted in the cavity and having a normal position, the tumblers being rotatably mounted on the shaft which is axially displaceable from its normal position for permitting the combination to be changed, the means provided by the shackle including a cam on the internal end of the leg engageable with one end of the shaft.

5. A combination padlock according to claim 4 wherein the cam has a relieved portion on one side and an operating portion on the opposite side, the relieved portion facing said one end of the shaft when the leg is retracted in its first angular position, the operating portion facing said one end of the shaft and engaging the same when the leg is retracted in its second angular position.

6. A combination padlock according to claim 1 including spring means urging the bolt into engagement with the tumblers which, when set on off combination and the leg is retracted in its first angular position, hold the bolt in an operative position at which a locking portion thereof engages the shackle and prevents the leg from moving to extended position, the spring means being effective to disengage the locking portion of the bolt from the shackle and move the bolt to an inoperative position when the tumblers are set in the on or open combination and the leg is retracted in its first angular position for allowing the leg to be moved to its extended position, the bolt being mounted for pivotal movement between its operative and inoperative positions, the spring means acting as a fulcrum for the bolt.

7. A combination padlock according to claim 6 wherein the spring means comprises a conically shaped coiled spring.

8. A combination padlock according to claim 6 wherein the spring means allows the bolt to be deflected by the scrambling of the combination when the leg is in its extended position.

9. A combination padlock according to claim 6 wherein the leg has a locking recess into which the locking portion of the bolt seats when the bolt is in its operative position and the leg is retracted in its first angular position, and the internal end of the leg between the locking recess and the free end of the leg has a relieved portion to provide clearance for the locking portion of the bolt when the leg is extended and the combination is scrambled allowing the bolt to move to its operative position.

10. A combination padlock according to claim 9 wherein the leg is provided with a cam portion intermediate the locking recess and the relieved portion, the cam portion engaging the locking portion of the bolt when the leg is in its first angular position and shifted from its extended toward its retracted position, and when the bolt is in its operative position, for moving the bolt to its inoperative position thereby allowing the leg to move to its retracted position at which point the bolt snaps into its operative position as the locking portion thereof enters the locking recess in the leg.

11. A combination padlock according to claim 4 wherein the body is provided with a plurality of spaced slots in communication with the cavity; wherein each tumbler comprises a sleeve rotatably mounted on the shaft and having a flanged end with a flat portion and a hub, a dial positioned in a slot and mounted on the hub, and cooperable means on the dial and sleeve for keying them together so that they rotate as a unit on the shaft; wherein the tumblers are set in the open combination when all of the flat portions of the flanges are in a predetermined angular position on the shaft; and wherein the shaft is headed at one end; spring means urging the dials and sleeves of the tumblers toward the headed end and into keying relationship and urging the shaft into its normal position; and wherein the means for preventing shifting are ribs on the body associated with each sleeve and positioned adjacent thereto when the shaft is in its normal position, each rib serving to block axial displacement of the flange with which it is associated except when the flat portion thereon is in said predetermined angular position.

12. A combination padlock according to claim 4 including spring means urging the bolt into engagement with the tumblers which, when set on off combination and the leg is retracted in its first angular position, hold the bolt in an operative position at which a locking portion thereof engages the shackle and prevents the leg from moving to extended position, the spring means being effective to disengage the locking portion of the bolt from the shackle and move the bolt to an inoperative position when the tumblers are set in the on or open combination and the leg is retracted in its first angular position for allowing the leg to be moved to its extended position, the bolt being mounted for pivotal movement between its operative and inoperative positions, the spring means acting as a fulcrum for the bolt.

13. A combination padlock according to claim 12 wherein the spring means comprises a conically shaped coiled spring.

14. A combination padlock according to claim 12 wherein the spring means allows the bolt to be deflected by the scrambling of the combination when the leg is in its extended position.

15. A combination padlock according to claim 12 wherein the leg has a locking recess into which the locking portion of the bolt seats when the bolt is in its operative position and the leg is retracted in its first angular position, and the internal end of the leg between the locking recess and the free end of the leg has a relieved portion to provide clearance for the locking portion of the bolt when the leg is extended and the combination is scrambled allowing the bolt to move to its operative position.

16. A combination padlock according to claim 15 wherein the leg is provided with a cam portion intermediate the locking recess and the relieved portion, the cam portion engaging the locking portion of the bolt when the leg is in its first angular position and shifted from its extended toward its retracted position, and when the bolt is in its operative position, for moving the bolt to its inoperative position thereby allowing the leg to move to its retracted position at which point the bolt snaps into its operative position as the locking portion thereof enters the locking recess in the leg.

17. A combination padlock according to claim 12 wherein the body is provided with a plurality of spaced slots in communication with the cavity; wherein each tumbler comprises a sleeve rotatably mounted on the shaft and having a flanged end with a flat portion and a hub, a dial positioned in a slot and mounted on the hub, and cooperable means on the dial and sleeve for keying them together so that they rotate as a unit on the shaft; wherein the tumblers are set in the open combination when all of the flat portions of the flanges are in a predetermined angular position on the shaft; and wherein the shaft is headed at one end; spring means urging the dials and sleeves of the tumblers toward the headed end and into keying relationship and urging the shaft into its normal position; and wherein the means for preventing shifting are ribs on the body associated with each sleeve and positioned adjacent thereto when the shaft is in its normal position, each rib serving to block axial displacement of the flange with which it is associated except when the flat portion thereof is in said predetermined angular position.

18. A combination padlock comprising:

a. a body with an internal cavity;

b. a shackle having a long leg extending into the cavity and rotatable in the body about its longitudinal axis, the leg being shiftable in the body along the axis thereof between retracted and extended positions;

c. a pivotal bolt in the cavity;

d. a plurality of rotatable tumblers;

e. a spring means urging the bolt into engagement with the tumblers which, when off combination and the leg is retracted in a first angular position, holds the bolt in an operative position at which a locking portion engages the shackle and prevents the leg from moving to extended position;

f. the spring means being effective to pivot the bolt and disengage the locking portion from the shackle when the tumblers are set to open combination and the leg is retracted in a first angular position for allowing the leg to be moved to its extended position; and g. said spring means serving as a fulcrum for the bolt as well as a bias therefor.

* * * * *